US011626054B2

(12) United States Patent
Park et al.

(10) Patent No.: US 11,626,054 B2
(45) Date of Patent: Apr. 11, 2023

(54) DISPLAY SYSTEM AND DRIVING METHOD THEREOF

(71) Applicant: Samsung Display Co., Ltd., Yongin-si (KR)

(72) Inventors: Se Hyuk Park, Yongin-si (KR); Hong Soo Kim, Yongin-si (KR); Jin Young Roh, Yongin-si (KR); Hae Kwan Seo, Yongin-si (KR); Jin Wook Yang, Yongin-si (KR); Hyo Jin Lee, Yongin-si (KR); Jae Keun Lim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/723,584

(22) Filed: Apr. 19, 2022

(65) Prior Publication Data

US 2022/0375380 A1 Nov. 24, 2022

(30) Foreign Application Priority Data

May 20, 2021 (KR) ..... 10-2021-0065093

(51) Int. Cl.
*G09G 3/20* (2006.01)

(52) U.S. Cl.
CPC ..... *G09G 3/20* (2013.01); *G09G 2310/027* (2013.01); *G09G 2310/066* (2013.01); *G09G 2320/0276* (2013.01)

(58) Field of Classification Search
CPC ..... G09G 3/20; G09G 2310/027; G09G 2310/066; G09G 2320/0276
See application file for complete search history.

(56) References Cited

U.S. PATENT DOCUMENTS

| | | | | |
|---|---|---|---|---|
| 10,559,280 | B2 | 2/2020 | Bae et al. | |
| 10,573,218 | B2 | 2/2020 | Bae et al. | |
| 10,607,548 | B2 | 3/2020 | Lee | |
| 2013/0278572 | A1 | 10/2013 | Lee et al. | |
| 2021/0027697 | A1* | 1/2021 | Yoon | G09G 3/20 |
| 2021/0056281 | A1* | 2/2021 | Shih | G09G 5/10 |
| 2021/0065602 | A1* | 3/2021 | Lee | G06F 1/3287 |
| 2021/0375193 | A1* | 12/2021 | Son | G09G 3/3233 |

FOREIGN PATENT DOCUMENTS

| | | |
|---|---|---|
| KR | 10-2018-0087644 | 8/2018 |
| KR | 10-2018-0104940 | 9/2018 |
| KR | 10-2019-0016634 | 2/2019 |
| KR | 10-2070660 | 1/2020 |

* cited by examiner

*Primary Examiner* — Andrew Sasinowski
(74) *Attorney, Agent, or Firm* — H.C. Park & Associates, PLC

(57) ABSTRACT

A display system and a driving method for a display system that includes an application processor configured to supply a mode control signal corresponding to a plurality of driving modes and input image data corresponding thereto; and a display module that includes pixels configured to display an image and configured to control any one of a plurality of gamma values and power source voltages supplied to the pixels in response to the plurality of driving modes.

16 Claims, 6 Drawing Sheets

IDATA : DATA1
IDATA' : DATA2, DATA3

IDATA : DATA1
IDATA' : DATA2, DATA3

DISPLAY SYSTEM AND DRIVING METHOD THEREOF

CROSS-REFERENCE TO RELATED APPLICATION

The application claims priority from and the benefit of Korean Patent Application No. 10-2021-0065093, filed on May 20, 2021, which is hereby incorporated by reference for all purposes as if fully set forth herein.

BACKGROUND

Field

Embodiments of the invention relate generally to a display system and a driving method thereof.

Discussion of the Background

In a display device, a driving frequency of pixels may vary according to a display mode. For example, in a normal image display mode (normal mode), the pixels may be driven at a relatively high frequency. In addition, in a standby mode (power saving mode) in which only minimal information (for example, time) is displayed, the pixels may be driven at a relatively low frequency.

When the pixels are driven at a low frequency in the display device, various solutions are being studied to reduce power consumption of the display device. In addition, even when the pixels are driven at the low frequency in the display device, various solutions are being studied for driving the normal image display mode (normal mode) by reducing deviation in luminance.

In addition, there is a need to increase user convenience by enabling various display modes (normal mode, power saving mode, and normal mode using a low frequency) to be driven according to a user's selection.

The above information disclosed in this Background section is only for understanding of the background of the inventive concepts, and, therefore, it may contain information that does not constitute prior art.

SUMMARY

A technical problem to be solved by at least one embodiment is to provide a display system capable of driving a normal image display mode using a low frequency, and a driving method thereof.

In addition, a technical problem to be solved by at least one embodiment is to provide a display system capable of providing various display modes according to a user's selection, and a driving method thereof.

In addition, a technical problem to be solved by at least one embodiment is to provide a display system capable of reducing power consumption of a display device using various display modes, and a driving method thereof.

Additional features of the inventive concepts will be set forth in the description which follows, and in part will be apparent from the description, or may be learned by practice of the inventive concepts.

A display system according to an embodiment may include an application processor configured to supply a mode control signal corresponding to a plurality of driving modes and input image data corresponding thereto; and a display module that includes pixels displaying an image and that is configured to control any one of a plurality of gamma values and power source voltages supplied to the pixels in response to the plurality of driving modes.

According to an embodiment, the plurality of driving modes may include a first mode driven at a first driving frequency; a second mode driven at a second driving frequency lower than the first driving frequency to minimize power consumption; and a third mode driven at a third driving frequency equal to or less than the first driving frequency.

According to an embodiment, the display module may include a gamma driver providing a first gamma value during periods in the first mode and the third mode and providing a second gamma value set to a voltage lower than the first gamma value with respect to the same grayscale during a period in the second mode.

According to an embodiment, the display module may further include a display driving circuit generating a data signal corresponding to the input image data of each of the plurality of driving modes and selecting pixel rows to which the data signal is supplied; and a display panel including the pixels and displaying the image in selected pixel rows based on the data signal.

According to an embodiment, the display driving circuit may include a data driver providing the data signal to the pixels; and a power supply supplying a source driving voltage to the data driver and supplying a first power source voltage and a second power source voltage to the pixels in the first mode and the third mode.

According to an embodiment, the data driver may generate a first auxiliary power source voltage and a second auxiliary power source voltage based on an external input voltage and the source driving voltage, and supply the first auxiliary power source voltage and the second auxiliary power source voltage to the pixels in the second mode.

According to an embodiment, the display system may further include an interface supplying the mode control signal and the input image data to the display module.

According to an embodiment, the application processor may provide the mode control signal and first image data corresponding to the first mode through the interface when driven in the first mode.

According to an embodiment, the application processor may provide the mode control signal and second image data corresponding to the second mode through the interface when driven in the second mode.

According to an embodiment, the application processor may provide the mode control signal and third image data corresponding to the third mode through the interface when driven in the third mode.

According to an embodiment, in the third mode, a scan driver may supply a first scan signal to each of even-numbered pixel rows in first writing periods of one frame and supply a second scan signal to each of odd-numbered pixel rows in second writing periods of the one frame.

A driving method of a display system including an application process and a display module according to an embodiment may include supplying, by the application processor, a mode control signal corresponding to a plurality of driving modes and input image data corresponding thereto; and controlling, by the display module including pixels displaying an image, any one of a plurality of gamma values and power source voltages supplied to the pixels in response to the plurality of driving modes.

According to an embodiment, the plurality of driving modes may include a first mode driven at a first driving frequency; a second mode driven at a second driving frequency lower than the first driving frequency to minimize power consumption; and a third mode driven at a third driving frequency equal to or less than the first driving frequency.

According to an embodiment, the display module may further include a gamma driver, and the controlling, by the display module including the pixels displaying the image, any one of the plurality of gamma values and the power source voltages supplied to the pixels in response to the plurality of driving modes, may include providing, by the display module, a first gamma value during periods in the first mode and the third mode; and providing a second gamma value set to a voltage lower than the first gamma value with respect to the same grayscale during a period in the second mode.

According to an embodiment, the display module may further include a display driving circuit and a display panel, and the controlling, by the display module including the pixels displaying the image, any one of the plurality of gamma values and the power source voltages supplied to the pixels in response to the plurality of driving modes, may include generating, by the display driving circuit, a data signal corresponding to the input image data of each of the plurality of driving modes and selecting pixel rows to which the data signal is supplied; and displaying, by the display panel including the pixels, the image in selected pixel rows based on the data signal.

According to an embodiment, the display driving circuit may further include a data driver and a power supply, and the controlling, by the display module including the pixels displaying the image, any one of the plurality of gamma values and the power source voltages supplied to the pixels in response to the plurality of driving modes, may include providing the data signal to the pixels by the data driver; and supplying a source driving voltage to the data driver and supplying a first power source voltage and a second power source voltage to the pixels in the first mode and the third mode.

According to an embodiment, the controlling, by the display module including the pixels displaying the image, any one of the plurality of gamma values and the power source voltages supplied to the pixels in response to the plurality of driving modes, may include generating, by the data driver, a first auxiliary power source voltage and a second auxiliary power source voltage based on an external input voltage and the source driving voltage; and supplying the first auxiliary power source voltage and the second auxiliary power source voltage to the pixels in the second mode.

According to an embodiment, the display system may further include an interface supplying the mode control signal and the input image data to the display module.

According to an embodiment, the supplying, by the application processor, the mode control signal corresponding to the plurality of driving modes and the input image data corresponding thereto, may include providing the mode control signal and first image data corresponding to the first mode through the interface when driven in the first mode; providing the mode control signal and second image data corresponding to the second mode through the interface when driven in the second mode; and providing the mode control signal and third image data corresponding to the third mode through the interface when driven in the third mode.

According to an embodiment, the controlling, by the display module including the pixels displaying the image, any one of the plurality of gamma values and the power source voltages supplied to the pixels in response to the plurality of driving modes, may further include supplying, by a scan driver, a first scan signal to each of even-numbered pixel rows in first writing periods of one frame in the third mode and supplying a second scan signal to each of odd-numbered pixel rows in second writing periods of the one frame.

It is to be understood that both the foregoing general description and the following detailed description are illustrative and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate illustrative embodiments of the invention, and together with the description serve to explain the inventive concepts.

DETAILED DESCRIPTION OF THE ILLUSTRATED EMBODIMENTS

Figure 1:
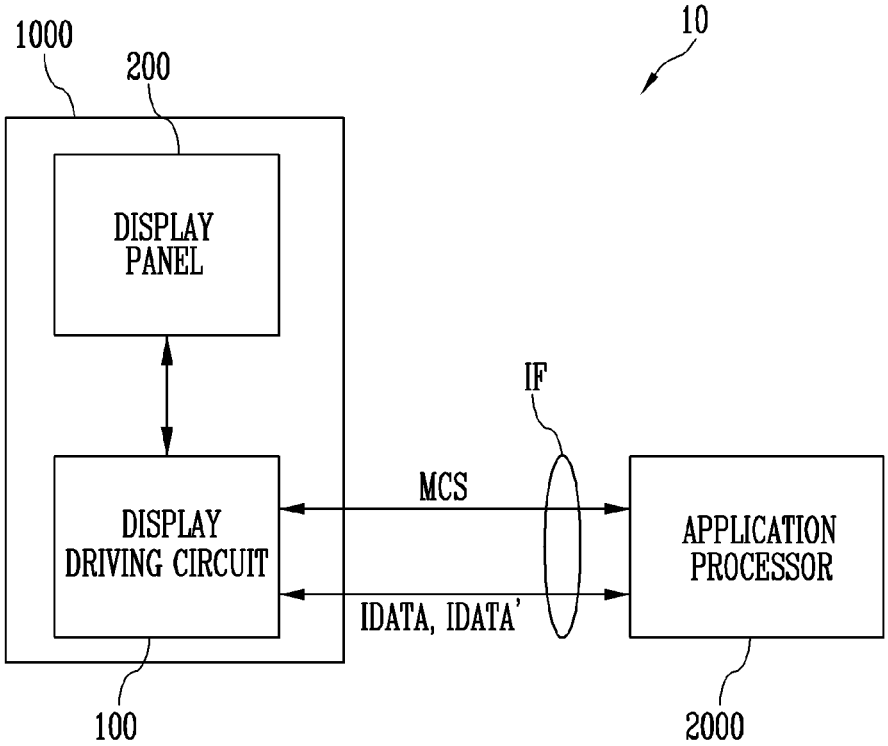
FIG. 1 is a diagram for explaining a display system according to an embodiment that is constructed according to principles of the invention.

In the following description, for the purposes of explanation, numerous specific details are set forth in order to provide a thorough understanding of various embodiments or implementations of the invention. As used herein "embodiments" and "implementations" are interchangeable words that are non-limiting examples of devices or methods employing one or more of the inventive concepts disclosed herein. It is apparent, however, that various embodiments may be practiced without these specific details or with one or more equivalent arrangements. In other instances, well-known structures and devices are shown in block diagram form in order to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing illustrative features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As is customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the scope of the inventive concepts. Further, the blocks, units, and/or modules of some embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Hereinafter, a display system according to an embodiment that is constructed according to principles of the invention will be described with reference to FIG. 1.

FIG. 1 is a diagram for explaining a display system according to an embodiment.

A display system 10 according to an embodiment may include a display module 1000, an application processor 2000, and an interface IF.

The display module 1000 according to an embodiment may further include a non-volatile memory, an additional storage device, an input/output device, a power management device, a communication module, a camera module, a sensor module, and the like.

In addition, the display module 1000 according to an embodiment may display an image in a normal mode (hereinafter, referred to as a first mode), an AOD (always on display) mode (hereinafter, referred to as a second mode), or an AOD_FSM (full screen mode) mode (hereinafter, referred to as a third mode).

The display module 1000 may display a normal image (for example, a moving image) in the first mode driven at a high frequency (or a first driving frequency) and may display a power saving image (for example, an image with a low load such as a watch) in the second mode driven at a low frequency (or a second driving frequency). In this case, since the power saving image may require relatively less power than the normal image, power consumption may be minimized. Also, in the third mode driven at a third driving frequency, a normal image (for example, a still image) may be displayed with a higher luminance than in the second mode displaying the power saving image.

In this case, the first driving frequency may correspond to 60 Hz, the second driving frequency may correspond to 30 Hz, and the third driving frequency may correspond to an arbitrary frequency between 1 Hz and 60 Hz.

In addition, the display module 1000 may be implemented as a device capable of using or supporting a mobile industry processor interface (MIPI), for example, a mobile device such as a mobile phone, a PDA, a PMP, a smart phone, a wearable device, or the like.

The application processor 2000 according to an embodiment may control overall operation of the display module 1000. The application processor 2000 may be implemented as a system-on-chip.

The application processor 2000 may transmit/receive data to and from a display driving circuit 100 included in the display module 1000 through the interface IF. In an embodiment, the interface IF may be a display serial interface (DSI). For example, the interface IF may correspond to the MIPI, and may confirm to a MIPI alliance specification for display serial interface and a MIPI alliance specification for D-PHY. However, this is an example, and the communication interface between the application processor 2000 and the display driving circuit 100 is not limited thereto. For example, in order to perform data transmission/reception according to embodiments, the MIPI alliance specification for display serial interface and the like may be partially modified. Alternatively, the interface IF may be configured as one of various serial high-speed interfaces supporting high-definition images of n-High Definition (nHD) or higher.

The application processor 2000 may generate input image data IDATA and IDATA' provided to the display module 1000 based on an external input, an image driving frequency, and the like.

The image driving frequency according to an embodiment may be the number of times an image frame is repeated for 1 second. The image driving frequency may be determined within the application processor 2000 by the external input or may be determined by the display driving circuit 100. When the image driving frequency is determined by the display driving circuit 100, information related to the image driving frequency may be provided to the application processor 2000 through the interface IF.

The application processor 2000 may be driven in the first mode, the second mode, and the third mode according to a user's setting. The application processor 2000 may supply first image data DATA1 as the input image data IDATA to the display driving circuit 100 during a period in the first mode. The display driving circuit 100 may display the first image data DATA1 on a display panel 200 at the first driving frequency corresponding to the first mode.

In addition, the application processor 2000 may supply second image data DATA2 or third image data DATA3 as the input image data IDATA' to the display driving circuit 100 during periods in the second mode and the third mode. Specifically, the application processor 2000 may supply the second image data DATA2 to the display driving circuit 100 during the period in the second mode, and may supply the third image data DATA3 to the display driving circuit 100 during the period in the third mode.

During the period driven in the second mode, the display driving circuit 100 may display the second image data DATA2 on the display panel 200 at the second driving frequency corresponding to the second mode. During the period driven in the third mode, the display driving circuit 100 may display the third image data DATA3 on the display panel 200 at the third driving frequency corresponding to the third mode.

Here, the first image data DATA1 may correspond to a moving image or the like, the second image data DATA2 may correspond to an AOD image (for example, a black-and-white image), and the third image data DATA3 may correspond to a normal image (for example, a color still image), but the embodiments described herein are not limited thereto.

That is, according to an embodiment, an AOD (always on display) image corresponding to the second mode or an AOD_FSM (full screen mode) image corresponding to the third mode may be displayed at a frequency lower than the first driving frequency (for example, a reference frequency).

The application processor 2000 may supply a mode control signal MCS to the display driving circuit 100 in response to a driving mode. Here, the mode control signal MCS may be composed of a predetermined digital bit corresponding to the first mode, the second mode, or the third mode, but the embodiments described herein are not limited thereto.

The display driving circuit 100 supplied with the mode control signal MCS may control the display panel 200 to be driven at a driving frequency corresponding to the mode. A detailed description related thereto will be described later with reference to FIG. 2.

Hereinafter, a display module according to an embodiment will be described with reference to FIG. 2.

Figure 2:
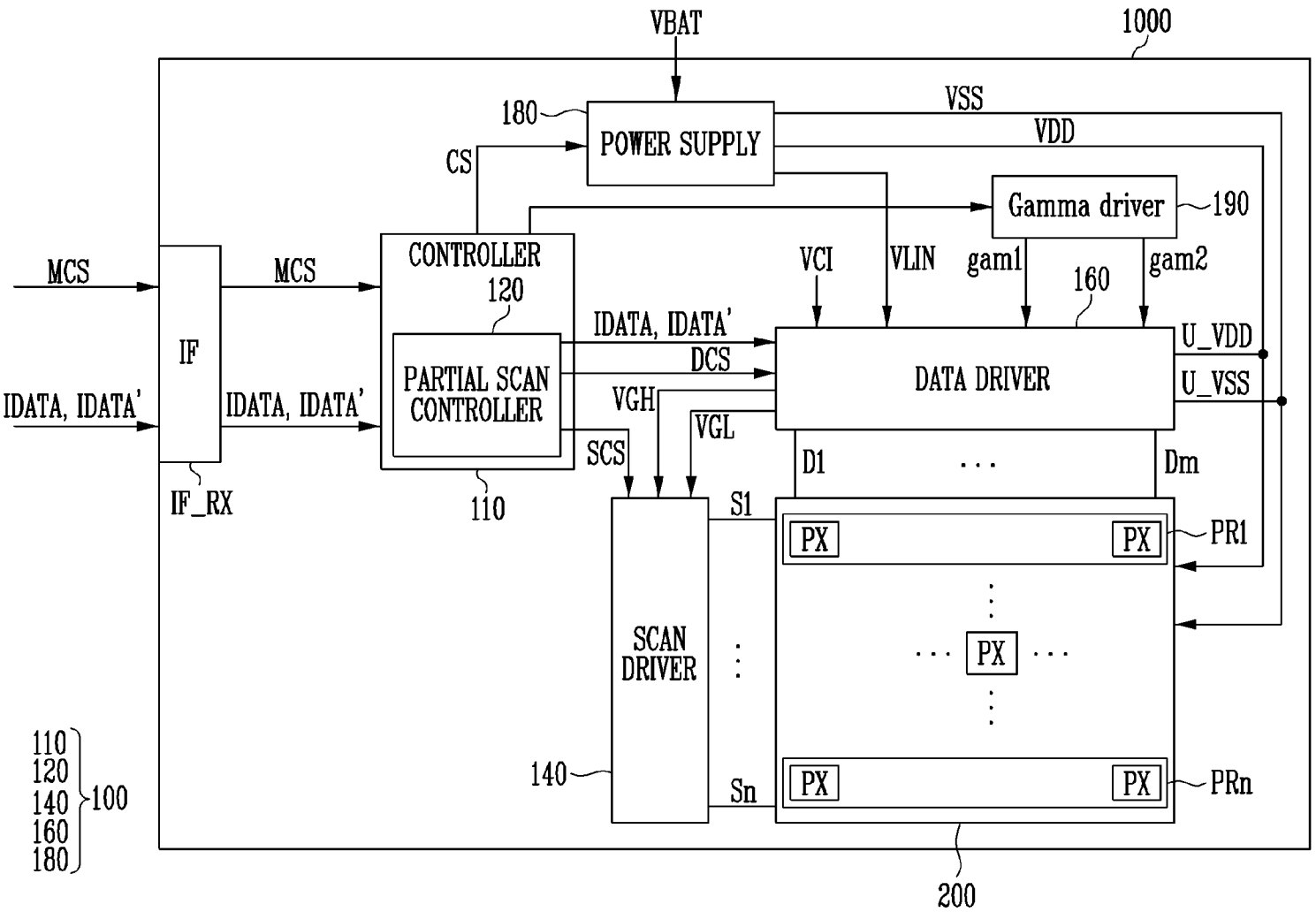
FIG. 2 is a diagram for explaining a display module according to an embodiment.

FIG. 2 is a diagram for explaining a display module according to an embodiment.

Referring to FIGS. 1 and 2, the display module 1000 (or display device) may include the display driving circuit 100 and the display panel 200.

The display module 1000 may be implemented as any one of a flat panel display device, a flexible display device, a curved display device, a foldable display device, a bendable display device, and a stretchable display device. Also, the display module 1000 may be applied to a transparent display device, a head-mounted device, a wearable device, and the like.

The display panel 200 may include scan lines S1 to Sn, data lines D1 to Dm, and pixels PX, where n and m may be integers greater than 1. The pixels PX may be electrically connected to the data lines D1 to Dm and the scan lines S1 to Sn. Pixels (or a pixel line) that are simultaneously controlled by one scan line and receive data signals substantially simultaneously may be understood as one pixel row. For example, pixels that receive a data signal based on a scan signal supplied to a first scan line S1 may be understood as a first pixel row PR1.

According to an embodiment, each of the pixels PX may be connected to at least one scan line, and may be additionally connected to an emission data line.

The pixels PX may emit light with a grayscale and a luminance corresponding to the data signal supplied from the data lines D1 to Dm. Each of the pixels PX may include a driving transistor, at least one switching transistor, a light emitting element, and a storage capacitor.

The light emitting element according to an embodiment may be electrically connected between a first power source voltage VDD and a second power source voltage VSS. Here, the first power source voltage VDD and the second power source voltage VSS may be a high potential voltage and a low potential voltage required to drive the pixels PX. The first power source voltage VDD may have a voltage level higher than that of the second power source voltage VSS, and may be provided through a power line.

The light emitting element according to an embodiment may be an organic light emitting element and/or an inorganic light emitting element. The switching transistor may transmit a data signal provided through one of the data lines D1 to Dm to the storage capacitor in response to a scan signal provided through one of the scan lines S1 to Sn. The storage capacitor may store the data signal. The driving transistor may be connected between the first power source voltage VDD and the light emitting element and may transmit a driving current corresponding to the data signal from the first power source voltage VDD to the light emitting element.

The display module 1000 according to an embodiment may include a reception interface IF_RX of the interface IF. The display module 1000 may receive the mode control signal MCS and the input image data IDATA or IDATA' supplied from the application processor 2000 through the reception interface IF_RX.

The display driving circuit 100 according to an embodiment may include a controller 110, a scan driver 140, and a data driver 160. The display driving circuit 100 may further include a power supply 180.

The controller 110 may function as a timing controller. In an embodiment, the controller 110 may generate a scan control signal SCS and a data control signal DCS based on clock signals, control signals, and a mode control signal MCS supplied from the application processor 2000. The clock signals and the control signals supplied from the application processor 2000 will be described later with reference to FIG. 4.

The scan control signal SCS may be supplied to the scan driver 140, and the data control signal DCS may be supplied to the data driver 160. In addition, the controller 110 may supply the input image data IDATA or IDATA' supplied from the application processor 2000 to the data driver 160.

The scan control signal SCS may include a scan start pulse and scan clock signals. The scan start pulse may control the first timing of the scan signal. The scan clock signals may be used to shift the scan start pulse.

The data control signal DCS may include a source start pulse and data clock signals. The source start pulse may control a sampling start time of rearranged image data. The data clock signals are used to control the sampling operation.

According to an embodiment, a partial scan controller 120 may be included in the controller 110. In FIG. 2, the partial scan controller 120 is shown as a component inside the controller 110, but this is an example, and at least a part of a function or a physical configuration of the partial scan controller 120 may be provided separately from the controller 110.

In an embodiment, the partial scan controller 120 may generate the scan control signal SCS corresponding to the partial scan driving and supply the scan control signal SCS to the scan driver 140. In addition, the partial scan controller 120 may generate the data control signal DCS corresponding to the partial scan driving and supply the data control signal DCS to the data driver 160. The partial scan controller 120 may be activated when driven in the third mode. Additionally, the function of the partial scan controller 120 may be generally performed by the controller 110, and in this case, the partial scan controller 120 may be omitted in some implementations of this embodiment.

For example, when the mode control signal MCS corresponding to the third mode is input, the partial scan controller 120 may be activated, and the scan control signal SCS and the data control signal DCS corresponding thereto may be generated. In addition, the partial scan controller 120 may rearrange the third image data DATA3 in response to the partial scan driving and supply the rearranged third image data DATA3 to the data driver 160.

The scan driver 140 may supply the scan signal to the scan lines S1 to Sn based on the scan control signal SCS. For example, the scan driver 140 according to an embodiment may sequentially supply the scan signal to the scan lines S1 to Sn in the first mode and the second mode. When the scan signal is sequentially supplied, the pixels PX may be selected in units of horizontal lines (or units of pixel rows). Specifically, the scan signal for writing data may be supplied to pixel rows during writing periods of one frame, and the supply of the scan signal may be stopped during power saving periods within one frame. For example, when one frame includes a writing period and a power saving period, the scan driver 140 may sequentially supply the scan signal to the scan lines connected to the pixel rows during the writing period and may stop the supply of the scan signal during the power saving period.

In addition, in the third mode according to an embodiment, the scan driver 140 controlled by the partial scan controller 120 may supply the scan signal for writing data to some pixel rows during the writing periods of one frame, and may stop the supply of the scan signal during the power saving periods within one frame. For example, when one frame includes a first writing period, a first power saving period, a second writing period, and a second power saving period, the scan driver 140 may sequentially supply the scan signal to the scan lines connected to odd-numbered pixel rows in the first writing period, and may sequentially supply the scan signal to the scan lines connected to even-numbered pixel rows in the second writing period. Also, the scan driver 140 may stop the supply of the scan signal during the first power saving period and the second power saving period.

In an embodiment, the controller 110 and the partial scan controller 120 may not generate signals for driving the scan driver 140 such as the scan control signal SCS during the power saving periods.

The data driver 160 according to an embodiment may receive the data control signal DCS and the input image data IDATA or IDATA'. The data driver 160 may generate the data signals using a gamma value gam1 or gam2 and the input image data IDATA or IDATA' and supply the data signals to the data lines D1 to Dm. For example, the data driver 160 may generates the data signals using a first gamma value gam1 during driving periods in the first mode and the third mode, and may generate the data signals using a second gamma value gam2 during a driving period in the second mode.

The data signal supplied to the data lines D1 to Dm may be supplied to the pixels PX selected by the scan signal. To this end, the data driver 160 may supply the data signal to the data lines D1 to Dm to be synchronized with the scan signal.

A gamma driver 190 may supply the gamma value gam1 or gam2 corresponding to a grayscale value to the data driver 160. Specifically, the gamma driver 190 may supply any one of the first gamma value gam1 and the second gamma value gam2 to the data driver 160 in response to the first mode, the second mode, and the third mode.

For example, the gamma driver 190 may supply the first gamma value gam1 to the data driver 160 during periods in the first mode and the third mode, and may supply the second gamma value gam2 to the data driver 160 during a period in the second mode.

The gamma driver 190 may supply different gamma values to the data driver 160 in response to the mode. For example, the gamma driver 190 may supply the first gamma value gam1 to the data driver 160 during the periods in the first mode and the third mode, and may supply the second gamma value gam2 to the data driver 160 during the period in the second mode.

Here, the first gamma value gam1 supplied during the periods in the first mode and the third mode may be set to a relatively high voltage value so that a color image or the like can be displayed. Also, the second gamma value gam2 supplied during the period in the second mode may be set to a voltage lower than the first gamma value gam1 so that a black-and-white image (or a power saving image) or the like can be displayed.

In FIG. 2, the gamma driver 190 according to an embodiment is shown as a component different from the data driver 160 or the controller 110. However, according to another embodiment, the gamma driver 190 may be integrally formed with at least one of the data driver 160 and the controller 110.

The data driver 160 according to an embodiment may generate the data signal using the first gamma value gam1 received from the gamma driver 190 during the periods in the first mode and the third mode, and may generate the data signal using the second gamma value gam2 having a voltage level lower than that of the first gamma value gam1 during the period in the second mode. In this case, in the first mode and the third mode, an image having a higher luminance may be displayed by using the first gamma value gam1 having a higher voltage than in the second mode. That is, the color image or the like can be displayed during the first mode and the third mode. Also, during the second mode, the black-and-white image or the power saving image can be displayed while reducing power consumption by using the second gamma value gam2 having the voltage level lower than that of the first gamma value gam1.

The data driver 160 according to an embodiment may receive a source driving voltage VLIN from the power supply 180, generate a first gate driving voltage VGH and a second gate driving voltage VGL based on a first external input voltage VCI and the source driving voltage VLIN provided from outside, and provide the first gate driving voltage VGH and the second gate driving voltage VGL to the scan driver 140.

One of the first gate driving voltage VGH and the second gate driving voltage VGL may have a turn-on voltage level that turns on a transistor included in the pixel PX, and the other of the first gate driving voltage VGH and the second gate driving voltage VGL may have a turn-off voltage level that turns off the transistor included in the pixel PX.

In the second mode according to an embodiment, the data driver 160 may generate a first auxiliary power source voltage U_VDD and a second auxiliary power source voltage U_VSS based on the first external input voltage VCI and the source driving voltage VLIN. Here, the first auxiliary power source voltage U_VDD may have a voltage level that is the same as or similar to that of the first power source voltage VDD, and the second auxiliary power source voltage U_VSS may have a voltage level that is the same as or similar to that of the second power source voltage VSS. That is, since the second mode is driven at the second driving frequency corresponding to the low frequency, the display panel 200 may be driven by the first auxiliary power source voltage U_VDD and the second auxiliary power source voltage U_VSS separately generated by the data driver 160 instead of the first power source voltage VDD and the second power source voltage VSS generated by the power supply 180.

In detail, the data driver 160 may generate the first gate driving voltage VGH, the second gate driving voltage VGL, the first auxiliary power source voltage U_VDD, and the second auxiliary power source voltage U_VSS through a power source converter including a boosting circuit and a regulating circuit.

Accordingly, the data driver 160 may provide the first auxiliary power source voltage U_VDD and the second auxiliary power source voltage U_VSS to the display panel 200 in the second mode. The first auxiliary power source voltage U_VDD may be provided to the pixel PX through a power line.

The power supply 180 according to an embodiment may generate the first power source voltage VDD, the second power source voltage VSS, and the source driving voltage VLIN based on a second external input voltage VBAT provided from an external power source. The power supply 180 may provide the source driving voltage VLIN to the data driver 160. The power supply 180 may provide the first power source voltage VDD and the second power source voltage VSS to the display panel 200 in the first mode or the third mode. The first power source voltage VDD may be provided to the pixel PX through a power line.

That is, in an embodiment, the power supply 180 may be driven differently in the first mode, the second mode, and the third mode. Specifically, in the second mode driven at the low frequency, the first auxiliary power source voltage U_VDD and the second auxiliary power source voltage U_VSS generated by the data driver 160 instead of the voltage generated by the power supply 180 may be used for driving, and in the first mode and the third mode, the first power source voltage VDD and the second power source voltage VSS generated by the power supply 180 may be used for driving.

That is, in the first mode or the third mode, the first power source voltage VDD and the second power source voltage VSS may be applied to the display panel 200 by the power supply 180 to ensure sufficient luminance. Also, in the second mode, the first auxiliary power source voltage U_VDD and the second auxiliary power source voltage U_VSS may be supplied by the data driver 160 to reduce or minimize the power consumption.

In the third mode according to an embodiment, the first power source voltage VDD and the second power source voltage VSS as in the first mode may be applied to the display panel 200 by the power supply 180. Also, the first gamma value gam1 as in the first mode may be applied to the display panel 200 by the gamma driver 190. Accordingly, when driven in the third mode, deterioration of image quality due to decrease in luminance occurring in the second mode can be prevented. In addition, when driven in the third mode, since the scan signal for periodically writing data to some different pixel rows, for example, odd-numbered or even-numbered pixel rows, during one frame can be supplied using the partial scan driving, deterioration of image quality due to flicker or the like can be prevented even when driven at a frequency lower than the frequency in the first mode.

Hereinafter, an example of the power supply according to an embodiment will be described with reference to FIG. 3.

Figure 3:
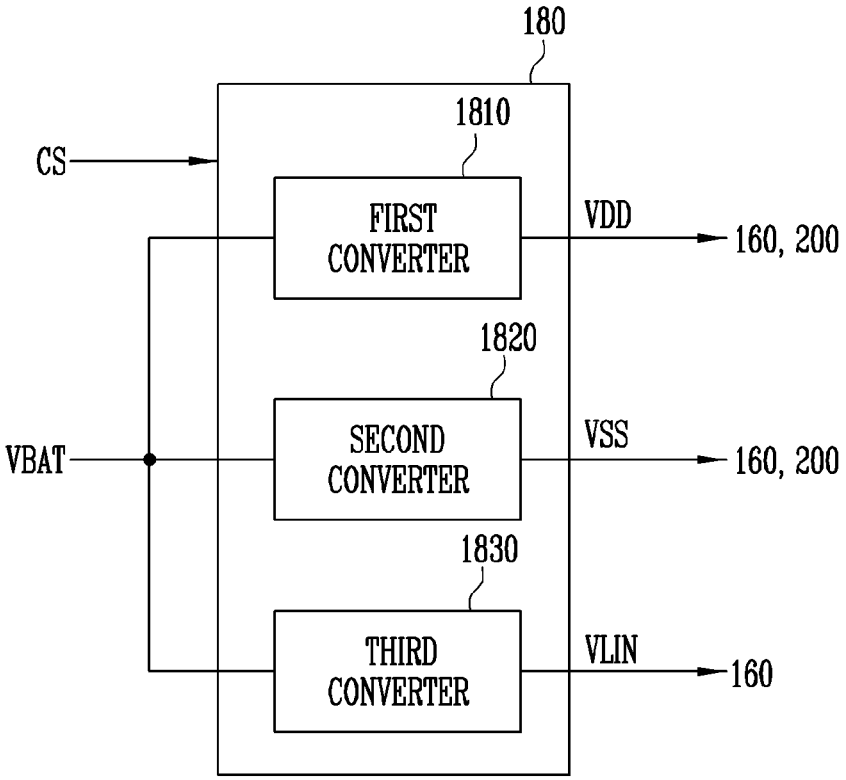
FIG. 3 is a diagram for explaining an example of a power supply according to an embodiment.

FIG. 3 is a diagram for explaining an example of a power supply according to an embodiment.

The power supply 180 may convert the second external input voltage VBAT to output the first power source voltage VDD, the second power source voltage VSS, and the source driving voltage VLIN. Also, the power supply 180 may be controlled by a power control signal CS. In addition, the power supply 180 may include a first converter 1810, a second converter 1820, and a third converter 1830.

The first converter 1810 may convert a voltage of the second external input voltage VBAT into the first power source voltage VDD. The second converter 1820 may convert the voltage of the second external input voltage VBAT into the second power source voltage VSS. The third converter 1830 may convert the voltage of the second external input voltage VBAT into a third power source voltage VILN. Here, the first converter 1810 and the third converter 1830 may be boost converters, and the second converter 1820 may be an inverting buck boost converter. The first converter 1810 and the second converter 1820 may operate in the first mode and the third mode, and the third converter 1830 may operate in the first to third modes.

As described above, the power supply 180 may include the first converter 1810, the second converter 1820, and the third converter 1830, may drive the first to third converters 1810 to 1830 in the first mode and the third mode, and may drive only the third converter 1830 in the second mode, thereby reducing power consumption.

Figure 4:
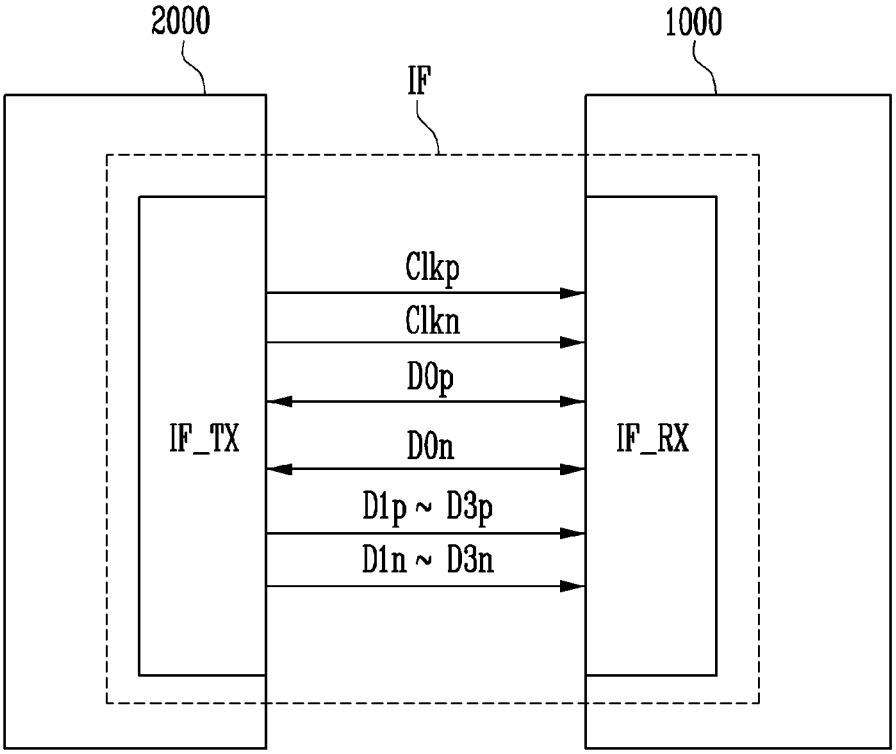
FIG. 4 is a diagram illustrating an interface according to an embodiment.

FIG. 4 is a diagram illustrating an interface according to an embodiment.

The interface IF according to an embodiment may include a transmission interface IF_TX included in the application processor 2000 and the reception interface IF_RX included in the display module 1000. The transmission interface IF_TX and the reception interface IF_RX may include one clock lane module and at least one data lane module.

Lane modules corresponding to each other may communicate through channels Clkp, Clkn, D0*p* to D3*p*, and D0*n* to D3*n*, respectively. In addition, a clock lane (or clock channel) may transmit MIPI clocks having different frequencies and swing levels to the display module 1000 according to an operation mode.

Each data lane (or data channel) may transmit MIPI data (for example, the input image data IDATA or IDATA') having different frequencies and swing levels to the display module 1000 according to the operation mode.

Additionally, in an embodiment, the mode control signal MCS may be transmitted from the transmission interface IF_TX to the reception interface IF_RX via a data lane. For example, the mode control signal MCS may be added to a data packet and transmitted through the data lane.

When the display system is driven in the first mode by a user's selection or the like, the application processor 2000 may supply the mode control signal MCS and first image data DATA1 corresponding to the first mode to the controller 110 using the interface IF. Here, the application processor 2000 may supply the first image data DATA1 in response to the first driving frequency (for example, 60 Hz).

The controller 110 may generate the scan control signal SCS and the data control signal DCS corresponding to the first mode (for example, the first driving frequency) and supply them to the scan driver 140 and the data driver 160, respectively. Also, the controller 110 may supply the power control signal CS corresponding to the first mode to the power supply 180, and control the gamma driver 190 to output the first gamma value gam1.

The power supply 180 receiving the power control signal CS corresponding to the first mode may generate the first power source voltage VDD and the second power source voltage VSS and supply them to the pixels PX.

The scan driver 140 receiving the scan control signal SCS may sequentially supply the scan signal to the scan lines S1 to Sn. The data driver 160 receiving the data control signal DCS may generate the data signals using the first gamma value gam1 and supply the data signals to the data lines D1 to Dm to be synchronized with the scan signal.

The pixels PX may receive the data signal when the scan signal is supplied. The pixels PX receiving the data signal may display a predetermined image by controlling the amount of current flowing from the first power source voltage VDD to the second power source voltage VSS through the light emitting element.

As described above, when driven in the first mode, the pixels PX may receive the first power source voltage VDD and the second power source voltage VSS, and the data driver 160 may generate the data signals using the first gamma value gam1. Accordingly, since the display system is driven at a relatively high first driving frequency, a moving image or the like can be displayed with sufficient luminance.

When the display system is driven in the second mode by a user's selection or the like, the application processor 2000 may supply the mode control signal MCS and the second image data DATA2 corresponding to the second mode to the controller 110 using the interface IF. Here, the application processor 2000 may supply the second image data DATA2 in response to the second driving frequency (for example, 30 Hz).

The controller 110 may generate the scan control signal SCS and the data control signal DCS corresponding to the second mode (for example, the second driving frequency) and supply them to the scan driver 140 and the data driver 160, respectively. Also, the controller 110 may supply the power control signal CS corresponding to the second mode to the power supply 180, and control the gamma driver 190 to output the second gamma value gam2.

The power supply 180 receiving the power control signal CS corresponding to the second mode may stop generating the first power source voltage VDD and the second power source voltage VSS.

The scan driver 140 receiving the scan control signal SCS may sequentially supply the scan signal to the scan lines S1 to Sn. The data driver 160 receiving the data control signal DCS may generate the first auxiliary power source voltage U_VDD and the second auxiliary power source voltage U_VSS and supply them to the pixels PX. Also, the data driver 160 may generate the data signals using the second gamma value gam2 and supply the data signals to the data lines D1 to Dm to be synchronized with the scan signal.

The pixels PX may receive the data signal when the scan signal is supplied. The pixels PX receiving the data signal may display a predetermined image by controlling the amount of current flowing from the first auxiliary power source voltage U_VDD to the second auxiliary power source voltage U_VSS through the light emitting element.

As described above, when driven in the second mode, the pixels PX may receive the first auxiliary power source voltage U_VDD and the second auxiliary power source voltage U_VSS, and the data driver 160 may generate the data signals using the second gamma value gam2. Accordingly, since the display system is driven at a relatively low second driving frequency, power consumption can be minimized.

When the display system is driven in the third mode by a user's selection or the like, the application processor 2000 may supply the mode control signal MCS and the third image data DATA3 corresponding to the third mode to the controller 110 using the interface IF. Here, the application processor 2000 may supply the third image data DATA3 in response to the third driving frequency (for example, 1 Hz to 60 Hz).

The controller 110 may generate the scan control signal SCS and the data control signal DCS corresponding to the third mode (for example, the third driving frequency) and supply them to the scan driver 140 and the data driver 160, respectively. Also, the controller 110 may supply the power control signal CS corresponding to the third mode to the power supply 180 and control the gamma driver 190 to output the first gamma value gam1.

The power supply 180 receiving the power control signal CS corresponding to the third mode may generate the first power source voltage VDD and the second power source voltage VSS and supply them to the pixels PX.

The scan driver 140 receiving the scan control signal SCS may alternately supply the scan signal to even-numbered scan lines and odd-numbered scan lines. The data driver 160 receiving the data control signal DCS may generate the data signals using the first gamma value gam1 and supply the data signals to the data lines D1 to Dm to be synchronized with the scan signal.

The pixels PX may receive the data signal when the scan signal is supplied. The pixels PX receiving the data signal may display a predetermined image by controlling the amount of current flowing from the first power source voltage VDD to the second power source voltage VSS through the light emitting element.

As described above, when driven in the third mode, the pixels PX may receive the first power source voltage VDD and the second power source voltage VSS, and the data driver 160 may generate the data signals using the first gamma value gam1. Accordingly, although the display system is driven at the third driving frequency lower than the first driving frequency, since the even-numbered or odd-numbered scan lines are driven alternately, a still image or the like can be displayed with sufficient luminance.

Hereinafter, an operation of the display system in the first mode according to an embodiment will be described with reference to FIG. 5.

Figure 5:
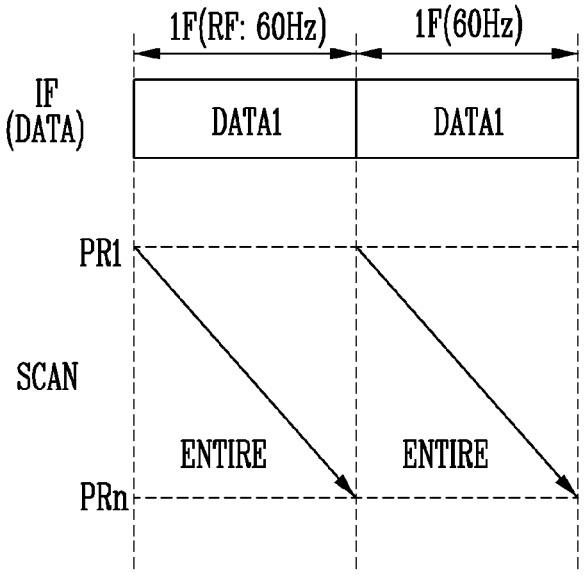
FIG. 5 is a diagram for explaining an operation of the display system in a first mode according to an embodiment.

FIG. 5 is a diagram for explaining an operation of the display system in a first mode according to an embodiment.

The first driving frequency in the first mode according to an embodiment may be 60 Hz corresponding to a reference frequency RF. When the first driving frequency for driving the first mode is 60 Hz, the partial scan controller 120 may be in an inactive state.

In this case, the application processor 2000 may provide the first image data DATA1 to the interface IF, and the first image data DATA1 transmitted through the interface IF may be supplied to the data driver 160 through the controller 110.

The scan driver 140 according to an embodiment may sequentially supply a scan signal SCAN to first to n-th pixel rows PR1 to PRn during one frame 1F in a normal driving method. The data driver 160 may drive from the first pixel of the first pixel row PR1 included in the display panel 200 to the last pixel of the n-th pixel row PRn (that is, the last pixel row) in response to the scan signal SCAN sequentially supplied to the first to n-th pixel rows PR1 to PRn.

In addition, the gamma driver 190 according to an embodiment may supply the first gamma value gam1 to the data driver 160. Accordingly, a high-quality moving image can be displayed in the first mode by using the first gamma value gam1 having a relatively higher voltage level than in the second mode.

Hereinafter, an operation of the display system in the second mode according to an embodiment will be described with reference to FIG. 6.

Figure 6:
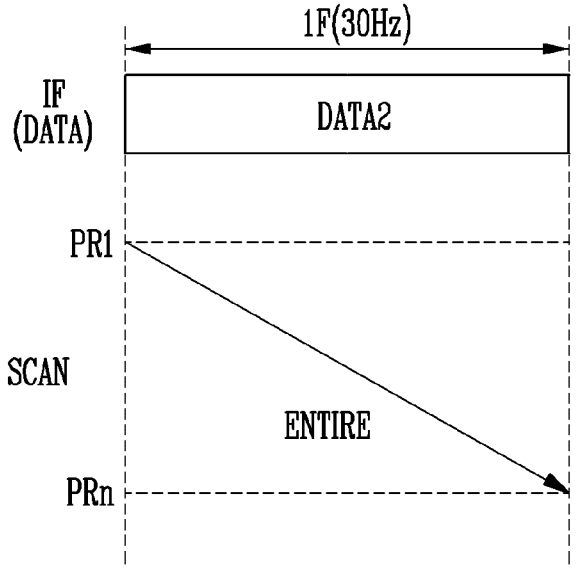
FIG. 6 is a diagram for explaining an operation of the display system in a second mode according to an embodiment.

FIG. 6 is a diagram for explaining an operation of the display system in a second mode according to an embodiment.

When the second driving frequency for driving the second mode according to an embodiment is lower than the reference frequency RF of 60 Hz, the partial scan controller 120 may be in an inactive state. In this case, the second driving frequency may correspond to about 30 Hz.

In this case, the application processor 2000 may provide the second image data DATA2 to the interface IF, and the second image data DATA2 transmitted through the interface IF may be supplied to the data driver 160 through the controller 110.

That is, compared to the first mode of FIG. 5, the display system may be driven at the second driving frequency (30 Hz) that is half of the first driving frequency. In addition, as discussed in FIG. 2, the data driver 160 in the second mode according to an embodiment may generate the first auxiliary power source voltage U_VDD and the second auxiliary power source voltage U_VSS based on the first external input voltage VCI and the source driving voltage VLIN. That is, since the second mode is driven at the second driving frequency corresponding to the low frequency, the display panel 200 may be driven by the first auxiliary power source voltage U_VDD and second auxiliary power source voltage U_VSS separately generated by the data driver 160 instead of the first power source voltage VDD and the second power source voltage VSS generated by the power supply 180.

That is, in the second mode, a power saving image corresponding to an image with a low load such as a watch can be displayed by applying the first and second auxiliary power source voltages U_VDD and U_VSS having voltage levels lower than the voltage level in the first mode and driving with the second driving frequency having the lower frequency. Power consumption can be reduced by displaying an image of one frame through this.

Additionally, in the second mode, the gamma driver 190 of FIG. 2 may supply the second gamma value gam2 having the voltage level lower than voltage levels in the periods in the first mode and the third mode to the data driver 160. Therefore, in the second mode, a power saving image corresponding to an image with a low load (or low luminance) can be displayed by using the second gamma value gam2 having a relatively low voltage level as well as the first and second auxiliary power source voltages U_VDD and U_VSS having low voltage levels.

Hereinafter, an operation of the display system in the third mode according to an embodiment will be described with reference to FIG. 7.

Figure 7:
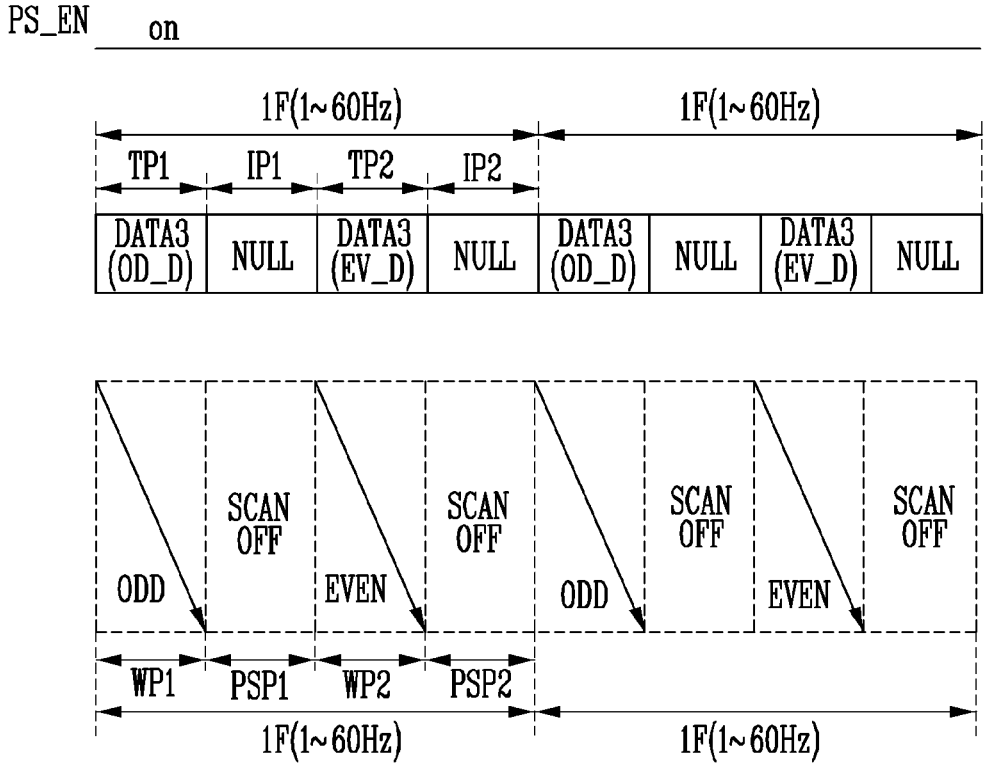
FIG. 7 is a diagram for explaining an operation of the display system in a third mode according to an embodiment.

FIG. 7 is a diagram for explaining an operation of the display system in a third mode according to an embodiment.

When the third driving frequency for driving the third mode according to an embodiment is lower than the reference frequency RF of 60 Hz, the partial scan controller 120 may be activated. For example, the third driving frequency may correspond to a frequency between about 1 Hz and 60 Hz.

The number of repetitions of transmission periods and interruption periods may be determined by the relationship between the reference frequency RF and the third driving frequency. When the third driving frequency corresponds to 30 Hz, which is half of the reference frequency RF, a first transmission period TP1, a second transmission period TP2, a first interruption period IP1, and a second interruption period IP2 may be set. The first and second transmission periods TP1 and TP2 and the first and second interruption periods IP1 and IP2 may be set to proceed alternately.

However, this is an example, and as the image driving frequency decreases, the number of repetitions of the transmission periods and the interruption periods may increase. For example, when the image driving frequency (third driving frequency) is 20 Hz, first to third transmission periods and first to third interruption periods may be set in correspondence to one frame, and the third image data DATA3 may be transmitted over the first to third transmission periods.

Specifically, in the third mode, the third image data may be divided corresponding to the first transmission period TP1 and the second transmission period TP2. In an embodiment, in the first transmission period TP1, odd-numbered data OD_D of image data DATA corresponding to the odd-numbered pixel rows may be serially output. In the second transmission period TP2, even-numbered data EV_D of the image data DATA corresponding to the even-numbered pixel rows may be serially output.

In addition, in the first interruption period IP1 and the second interruption period IP2, the output of the third image data DATA3 and the transmission of the image data DATA by the interface IF may be stopped. In this case, in the first and second interruption periods IP1 and IP2, functions of power sources and control circuits for outputting and transmitting the third image data DATA3 may be turned off. Accordingly, power consumption can be reduced.

In a first writing period WP1, data signals converted from the odd-numbered data OD_D may be written in the odd-numbered pixel rows. That is, in the first writing period WP1, the scan signal SCAN for writing data into the odd-numbered pixel rows may be sequentially supplied. When driven in the third mode, compared with the first driving frequency (60 Hz) for driving the first mode, since the pixel rows to which the scan signal SCAN is supplied are reduced by half, the length of the first writing period WP1 may correspond to about half the time the scan signal SCAN is supplied to all pixel rows when driven at 60 Hz.

In a second writing period WP2, data signals converted from the even-numbered data EV_D may be written in the even-numbered pixel rows. That is, in the second writing period WP2, the scan signal SCAN for writing data into the even-numbered pixel rows may be sequentially supplied.

In a first power saving period PSP1, an image of the odd-numbered pixel rows may be displayed, and in a second power saving period PSP2, an image of the even-numbered pixel rows may be displayed. In the first power saving period PSP1 and the second power saving period PSP2, the supply of the scan signal SCAN and the supply of the data signals may be stopped. In addition, some functions of the controller 110 for driving the scan driver 140 and the data driver 160 may also be deactivated.

That is, compared to the first mode of FIG. 5, the display system may be driven at the third driving frequency that is smaller than the first driving frequency. In addition, as discussed in FIG. 3, the power supply 180 according to an embodiment may generate the first power source voltage VDD, the second power source voltage VSS, and the source driving voltage VLIN based on the second external voltage VBAT provided from the external power source. The power supply 180 may provide the source driving voltage VLIN to the data driver 160. The power supply 180 may provide the first power source voltage VDD and the second power source voltage VSS to the display panel 200. The first power source voltage VDD may be provided to the pixel PX through a power line.

That is, in the third mode, a high-quality image (that is, a normal image or a still image) having a higher luminance than in the second mode may be displayed by using a frequency lower than the first driving frequency driving the first mode and applying the same first and second power source voltages VDD and VSS as in the third mode.

In addition, in the third mode, the gamma driver 190 of FIG. 2 may supply the first gamma value gam1 having the voltage level higher than that of the second mode to the data driver 160. Accordingly, in the third mode, a normal image or a still image having a higher luminance than in the second mode can be displayed by using the first gamma value gam1 having a relatively high voltage level.

In addition, in the third mode, the scan signal for periodically writing data to some different pixel rows, for example, the odd-numbered or even-numbered pixel rows, during one frame can be supplied alternately using the partial scan driving. Therefore, a high-quality image having a luminance similar to that of the first mode can be displayed even when driven at a frequency lower than the frequency in the first mode.

Hereinafter, referring to FIG. 8, when the third mode according to an embodiment is driven at the image driving frequency of 30 Hz, a change in luminance is schematically shown.

Figure 8:
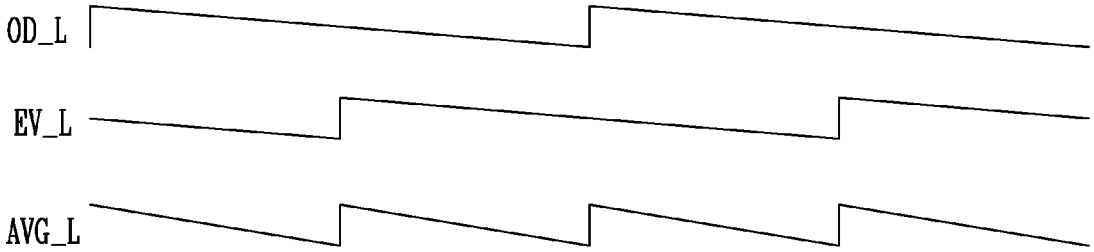
FIG. 8 is a diagram schematically illustrating a change in luminance when the third mode according to an embodiment is driven at an image driving frequency of 30 Hz.

FIG. 8 is a diagram schematically illustrating a change in luminance when the third mode according to an embodiment is driven at an image driving frequency of 30 Hz.

A first luminance OD_L, which is the luminance of the odd-numbered pixel rows, and a second luminance EV_L, which is the luminance of the even-numbered pixel rows, may be detected differently by the partial scan driving in the third mode.

The pixel may include the light emitting element that emits light by the driving current. Leakage of the driving current may occur due to intrinsic characteristics of transistors included in the pixel. Accordingly, when the light emitting element emits light after data is written, the luminance may decrease as time elapses due to the leakage of the driving current.

As shown in FIG. 7, the first writing period WP1 for the odd-numbered pixel rows and the second writing period WP2 for the even-numbered pixel rows may be alternately repeated with a cycle of 30 Hz.

Accordingly, the first luminance OD_L and the second luminance EV_L may be refreshed every 33.4 ms, respectively. Accordingly, an average luminance AVG_L, which is an average of the first luminance OD_L and the second luminance EV_L, may show a change in luminance similar to that when driven at 60 Hz.

That is, in the third mode, the change in luminance similar to that in the first mode can be generated by using a frequency lower than the first driving frequency in the first mode.

The display system and the driving method thereof according to embodiments described herein may implement a normal image display mode by using a low frequency.

In addition, the display system and the driving method thereof according embodiments described herein may provide various display modes according to a user's selection.

Furthermore, the display system and the driving method thereof according to embodiments described herein may reduce power consumption of the display device by using various display modes.

Although certain embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display system comprising:

an application processor configured to supply a mode control signal corresponding to a plurality of driving modes and input image data corresponding thereto; and a display module including pixels configured to display an image and configured to control any one of a plurality of gamma values and power source voltages supplied to the pixels in response to the plurality of driving modes, wherein the plurality of driving modes includes:

a first mode driven at a first driving frequency;

a second mode driven at a second driving frequency lower than the first driving frequency to minimize power consumption; and a third mode driven at a third driving frequency equal to or less than the first driving frequency, wherein the display module includes:

a gamma driver configured to provide a first gamma value during periods in the first mode and the third mode and configured to provide a second gamma value set to a voltage lower than the first gamma value with respect to the same grayscale during a period in the second mode.

2. The display system of claim 1, wherein the display module further includes:

a display driving circuit configured to generate a data signal corresponding to the input image data of each of the plurality of driving modes, and configured to select pixel rows to which the data signal is supplied; and a display panel including the pixels and configured to display the image in selected pixel rows based on the data signal.

3. The display system of claim 2, wherein the display driving circuit includes:

a data driver configured to provide the data signal to the pixels; and a power supply configured to supply a source driving voltage to the data driver, and configured to supply a first power source voltage and a second power source voltage to the pixels in the first mode and the third mode.

4. The display system of claim 3, wherein the data driver is configured to generate a first auxiliary power source voltage and a second auxiliary power source voltage based on an external input voltage and the source driving voltage, and wherein the data driver is configured to supply the first auxiliary power source voltage and the second auxiliary power source voltage to the pixels in the second mode.

5. The display system of claim 4, further comprising:

an interface configured to supply the mode control signal and the input image data to the display module.

6. The display system of claim 5, wherein the application processor is configured to provide the mode control signal and first image data corresponding to the first mode through the interface when driven in the first mode.

7. The display system of claim 5, wherein the application processor is configured to provide the mode control signal and second image data corresponding to the second mode through the interface when driven in the second mode.

8. The display system of claim 5, wherein the application processor is configured to provide the mode control signal and third image data corresponding to the third mode through the interface when driven in the third mode.

9. The display system of claim 8, wherein in the third mode, a scan driver is configured to supply a first scan signal to each of even-numbered pixel rows in first writing periods of one frame, wherein the scan driver is configured to supply a second scan signal to each of odd-numbered pixel rows in second writing periods of the one frame.

10. A driving method of a display system including an application processor and a display module, comprising:

supplying, by the application processor, a mode control signal corresponding to a plurality of driving modes and input image data corresponding thereto; and controlling, by the display module that includes pixels displaying an image, any one of a plurality of gamma values and power source voltages supplied to the pixels in response to the plurality of driving modes, wherein the plurality of driving modes includes:

a first mode driven at a first driving frequency;

a second mode driven at a second driving frequency lower than the first driving frequency to minimize power consumption; and a third mode driven at a third driving frequency equal to or less than the first driving frequency, wherein the display module further includes a gamma driver, and wherein the controlling, by the display module including the pixels displaying the image, any one of the plurality of gamma values and the power source voltages supplied to the pixels in response to the plurality of driving modes, includes:

providing, by the display module, a first gamma value during periods in the first mode and the third mode; and providing a second gamma value set to a voltage lower than the first gamma value with respect to the same grayscale during a period in the second mode.

11. The driving method of claim 10, wherein the display module further includes a display driving circuit and a display panel, and wherein the controlling, by the display module including the pixels displaying the image, any one of the plurality of gamma values and the power source voltages supplied to the pixels in response to the plurality of driving modes, includes:

generating, by the display driving circuit, a data signal corresponding to the input image data of each of the plurality of driving modes and selecting pixel rows to which the data signal is supplied; and displaying, by the display panel including the pixels, the image in selected pixel rows based on the data signal.

12. The driving method of claim 11, wherein the display driving circuit further includes a data driver and a power supply, and wherein the controlling, by the display module including the pixels displaying the image, any one of the plurality of gamma values and the power source voltages supplied to the pixels in response to the plurality of driving modes, includes:

providing the data signal to the pixels by the data driver; and supplying a source driving voltage to the data driver and supplying a first power source voltage and a second power source voltage to the pixels in the first mode and the third mode.

13. The driving method of claim 12, wherein the controlling, by the display module including the pixels displaying the image, any one of the plurality of gamma values and the power source voltages supplied to the pixels in response to the plurality of driving modes, includes:

generating, by the data driver, a first auxiliary power source voltage and a second auxiliary power source voltage based on an external input voltage and the source driving voltage; and supplying the first auxiliary power source voltage and the second auxiliary power source voltage to the pixels in the second mode.

14. The driving method of claim 13, wherein the display system further includes an interface supplying the mode control signal and the input image data to the display module.

15. The driving method of claim 14, wherein the supplying, by the application processor, the mode control signal corresponding to the plurality of driving modes and the input image data corresponding thereto, includes:

providing the mode control signal and first image data corresponding to the first mode through the interface when driven in the first mode;

providing the mode control signal and second image data corresponding to the second mode through the interface when driven in the second mode; and providing the mode control signal and third image data corresponding to the third mode through the interface when driven in the third mode.

16. The driving method of claim 15, wherein the controlling, by the display module including the pixels displaying the image, any one of the plurality of gamma values and the power source voltages supplied to the pixels in response to the plurality of driving modes, further includes:

supplying, by a scan driver, a first scan signal to each of even-numbered pixel rows in first writing periods of one frame in the third mode and supplying a second scan signal to each of odd-numbered pixel rows in second writing periods of the one frame.

* * * * *